US009072350B2

(12) United States Patent
Groth

(10) Patent No.: US 9,072,350 B2
(45) Date of Patent: Jul. 7, 2015

(54) HAIR ACCESSORY ORGANIZER AND STORAGE DEVICE

(71) Applicant: Kelly Groth, Meriden, CT (US)

(72) Inventor: Kelly Groth, Meriden, CT (US)

( * ) Notice: Subject to any disclaimer, the term of this patent is extended or adjusted under 35 U.S.C. 154(b) by 189 days.

(21) Appl. No.: 13/789,015

(22) Filed: Mar. 7, 2013

(65) Prior Publication Data

US 2014/0083887 A1 Mar. 27, 2014

Related U.S. Application Data

(60) Provisional application No. 61/607,732, filed on Mar. 7, 2012.

(51) Int. Cl.
*A63H 3/00* (2006.01)
*A45C 11/00* (2006.01)
*A45D 8/00* (2006.01)

(52) U.S. Cl.
CPC . *A45C 11/00* (2013.01); *A45D 8/00* (2013.01); *A45D 2008/002* (2013.01)

(58) Field of Classification Search
CPC ..... A63H 3/003; A63H 3/005
USPC ..... 446/71, 73, 75; 206/338, 343, 345, 805; 211/13.1, 85.2; D19/75; D28/73
See application file for complete search history.

(56) References Cited

U.S. PATENT DOCUMENTS 612,173 A * 10/1898 Newton ..... 473/576
3,785,643 A * 1/1974 Rich ..... 482/86
3,918,132 A * 11/1975 McGahee ..... 206/338
5,626,503 A * 5/1997 Heftel et al. ..... 446/73
D394,918 S * 6/1998 Gillmore et al. ..... D28/73
5,909,809 A * 6/1999 Franklin ..... 206/525
6,062,232 A * 5/2000 Johnson ..... 132/273
D427,378 S * 6/2000 Pritchett et al. ..... D28/73
6,186,737 B1 * 2/2001 Cohen ..... 414/800
D457,271 S * 5/2002 Jackson ..... D28/73
6,638,133 B1 * 10/2003 Brancolino et al. ..... 446/73
6,672,463 B2 * 1/2004 Dashefsky ..... 211/13.1
6,682,035 B1 * 1/2004 Hart ..... 248/309.2
D562,906 S * 2/2008 Deljanin ..... D19/75
2004/0164034 A1 * 8/2004 Costanza ..... 211/13.1
2005/0194334 A1 * 9/2005 Johnson ..... 211/85.2
2006/0094573 A1 * 5/2006 Weck ..... 482/126

* cited by examiner

*Primary Examiner* — Kurt Fernstrom

(74) *Attorney, Agent, or Firm* — MKG, LLC

(57) ABSTRACT

A device is presented for storing and organizing flexible objects including hair accessories. The device includes a first body having a surface that defines an internal cavity. The device includes a strand or tube attached to and extending from the first body. A flexible object is disposed over the strand or tube and is retained by the strand or tube and the first body. In one embodiment, the device further includes a container having a cylindrical shape defining a chamber. The container has an opened and a closed end to define an internal volume. The internal volume is suitable for storing flexible items. In another embodiment, the device further includes a foldable carrying container having an external surface and an internal surface. The foldable container is selectively configurable in an open and a closed position. One or more straps coupled to the internal surface to retain the flexible items.

13 Claims, 11 Drawing Sheets

HAIR ACCESSORY ORGANIZER AND STORAGE DEVICE

CROSS-REFERENCE TO RELATED APPLICATION

This patent application claims benefit under 35 U.S.C. §119(e) of copending, U.S. Provisional Patent Application, Ser. No. 61/607,732, filed Mar. 7, 2012, the disclosure of which is incorporated by reference herein in its entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the United States Patent and Trademark Office files or records, but otherwise reserves all copyright rights whatsoever.

BACKGROUND OF THE INVENTION

1. Field of the Invention

This invention relates to a device for storing and organizing flexible items and, more particularly, to a device for storing and organizing flexible bands and clips such as hair accessories including hair bands, hair clips, pony tail holders, and the like, when not in use.

2. Description of the Related Art

Hair accessories are used for grooming, styling, giving a person's hair a more attractive appearance, and for retaining the person's hair in a given location during grooming, styling or while conducting certain activities. Common hair accessories include barrettes, clamps, scrunchies, combs, pins, hair bands, hair clips, pony tail holders, and elastic bands. When not in use, it is not unusual to find large quantities or assortment of these hair accessories on a user's, typically a female's, dresser, counter, in a drawer, as well as on or in other locations.

Storage and organization of hair accessories, especially large quantities or assortments, present a problem to most users. Typically, hair accessories are not organized at all and therefore clutter valuable dresser, counter, and drawer space. Given a lack of a convenient storage device, hair accessories may be found lying lost throughout a household, educational facility or other area where many users, particularly young users, are present.

Accordingly, there is a need for a device for the storage and organization of a wide variety of hair accessories.

SUMMARY OF THE INVENTION

The present invention is directed to a device for storing and organizing flexible objects including hair accessories. The device includes a first body having a surface arranged to define an internal cavity. The internal cavity contains padding to enlarge the first body to a desired size and shape. In one embodiment, the first body is solid and does not require padding to assume the desired size, shape or other configuration. The device also includes a strand or tube attached to the surface and extending outwardly from the first body. A flexible object is disposed over the strand or tube and is retained by the strand or tube and the first body.

In one embodiment, the first body is comprised of a fabric, paper, plastic, foam, wood or like material. In one embodiment, the strand or tube is comprised of fabric, metal, wire, string, yarn, plastic, or ribbon having a desired thickness or diameter and a length. In yet another embodiment, the device for storing and organizing flexible objects further includes a second body having a second surface arranged to define a second internal cavity. The second cavity contains padding to enlarge the second body to a desired size and shape. The second body is coupled to the strand or tube at an end of the strand or tube opposite from the first body.

In one embodiment, the device for storing and organizing flexible objects further includes a container having a cylindrical shape defining a chamber. The container has an opened end and a closed end such that the chamber defines an internal volume between the opened end and the closed end. The internal volume is suitable for storing flexible items and other items therein. The container is coupled to the strand or tube at an end of the strand or tube opposite from the first body.

In one embodiment, the device for storing and organizing flexible objects further includes a foldable carrying container having an external surface and an internal surface. The foldable container is selectively configurable in an open position, a closed position and positions between the open and closed positions. The device further includes one or more straps coupled to the internal surface to retain the flexible items thereon. The carrying container is coupled to the strand or tube at an end of the strand or tube opposite from the first body.

BRIEF DESCRIPTION OF THE DRAWINGS

The features and advantages of the present invention will be better understood when the Detailed Description of the Preferred Embodiments given below is considered in conjunction with the figures provided.

In these figures like structures are assigned like reference numerals, but may not be referenced in the description of all figures.

DETAILED DESCRIPTION OF THE PREFERRED EMBODIMENTS

Figure 1:
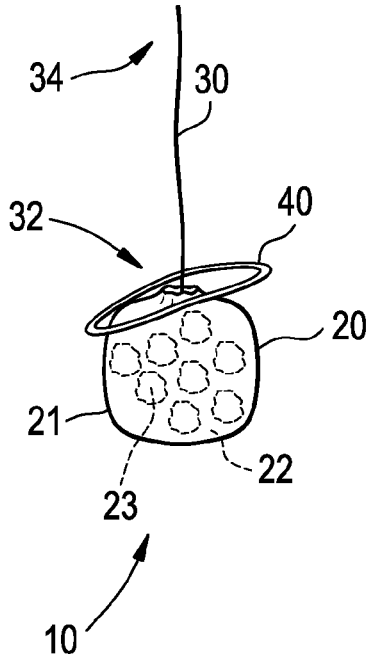
FIG. 1 is a front elevational view of a device for storing and organizing flexible items, configured in accordance with one embodiment of the present invention.

In one aspect of the invention, illustrated in FIG. 1, a device 10 for storing and organizing flexible items includes a first body 20 of a desired size, shape and material, for example, a ball or spherical shape. The device 10 may be offered for sale under a Tied-ees brand (TIED-EES is a trademark of Kelly Groth, Meriden, Conn.). In one embodiment, the first body 20 is comprised of surface 21 of fabric, leather, vinyl or like material that is wrapped or folded to define an internal cavity 22. The internal cavity 22 is stuffed or padded with material 23, for example, cotton, foam or the like, to enlarge the size or shape of the first body 20 while making the first body 20 pliable (e.g., compressible) within a hand of a user. For example, a force may be exerted on the first body 20 to compress the material 23 within the internal cavity 22 such that one or more flexible items can pass over the first body. Once the force is withdrawn, the material 23 returns to its original or substantially original form such that the flexible items cannot pass over the first body 20. Once the surface 21 is wrapped to encompass the stuffing or padding material 23, ends of the surface 21 are sewn or otherwise fastened or secured together to form the ball or spherical shape.

In one embodiment, the first body 20 is comprised of a solid structure, e.g., a body which includes the surface 21 but does not necessarily include the internal cavity 22, of plastic, paper, foam, or like material. In this solid structure, the first body 20 need not be pliable. Rather, the flexible items are expanded to pass over the first body 20 and when released, the flexible items return to substantially their original form and rest on the first body 20 unable to pass back over the same.

A strand or tube 30 is attached to the surface 21 and extends outwardly from the first body 20. For example, a first end 32 of the strand or tube 30 is affixed to the surface 21 of the first body 20 and a second end 34 of the strand or tube 30 extends outwardly from the first body 20. The strand or tube 30 can be constructed from any type of material such as, for example, fabric, metal, wire, string, yarn, plastic, ribbon, and the like, having a desired thickness or diameter and a length. As should be appreciated, the first body 20 and the strand or tube 30 define the device 10 by which flexible items 40 including hair accessories such as, for example, barrettes, clamps, scrunchies, combs, pins, hair bands, hair clips, pony tail holders, and elastic bands, can be placed over the strand or tube 30 and retained by the first body 20 without falling off as shown in FIG. 1.

Figure 2:
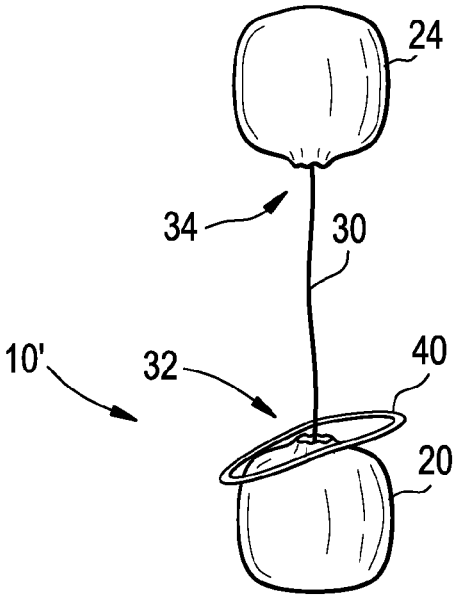
FIG. 2 is a front elevational view of a device for storing and organizing flexible items, configured in accordance with one embodiment of the present invention.

In one embodiment, the strand or tube 30 may be used to affix the device 10 from or about, for example, a door, door knob, hook or like protrusion, shelf or like support surface (not shown). In one embodiment, a fastening mechanism such as, for example, a quick-release clamp, clip or the like, is affixed to the second end 34 of the strand or tube 30 and may be used to secure the strand or tube 30 to the support surface. In another embodiment, illustrated in FIG. 2, a device 10', which is similar to device 10, may include a second body 24, which is similar in function and/or size and shape to the first body 20, and disposed at the second end 34 of the strand or tube 30 opposite from the first body 20. While the second body 24 is described as being of a similar size and shape as the first body 20 it should be appreciated that the size and shape of the first body 20 and the second body 24 may vary depending on the needs or desires of the user and/or flexible items 40 to be retained.

Figure 3A:
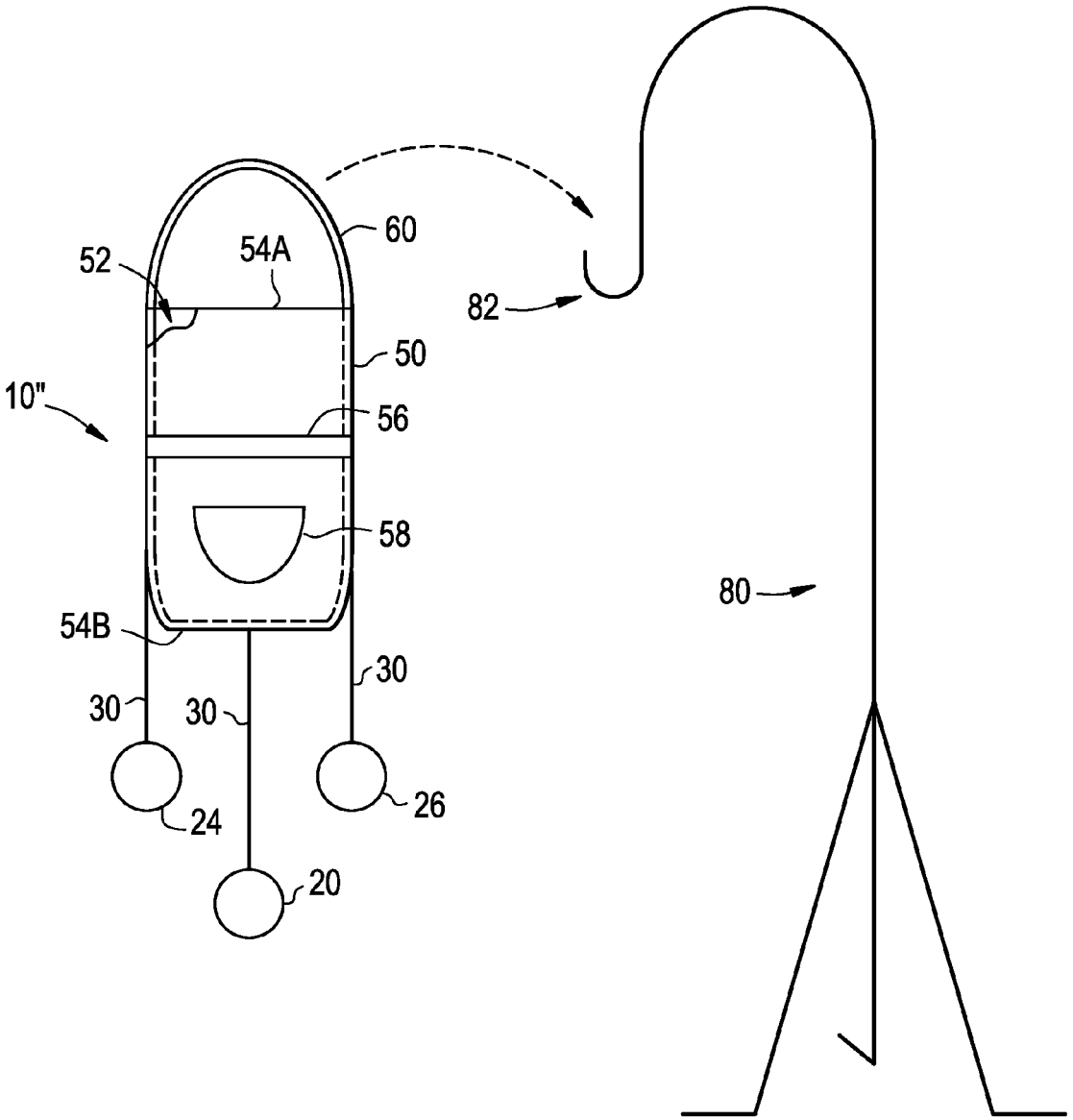
FIG. 3A is a front, partially cross-sectional view of a device for storing and organizing flexible items, configured in accordance with one embodiment of the present invention.
Figure 3B:
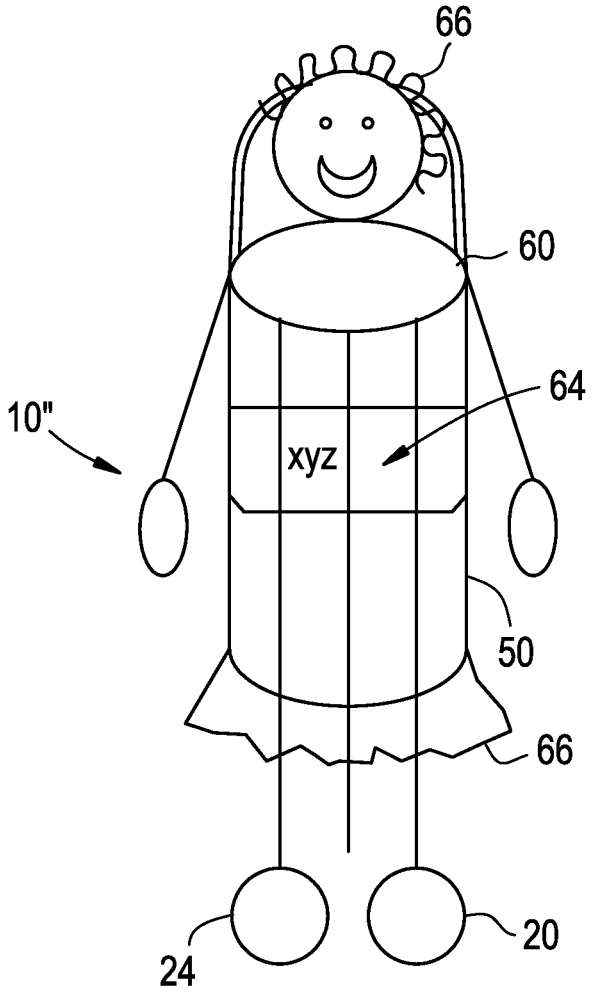
FIG. 3B is the device of FIG. 3A further including embellishments, in accordance with one embodiment of the present invention.
Figure 7A:
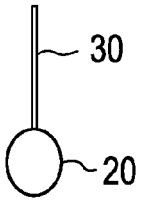
FIGS. 7A-7P illustrates devices for storing and organizing flexible items, in accordance with embodiments of the present invention.
Figure 7B:
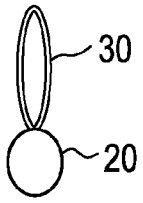
Figure 7C:
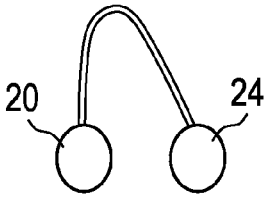
Figure 7D:
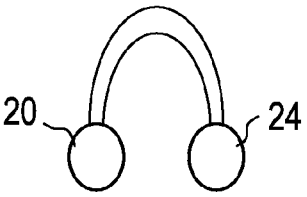
Figure 7E:
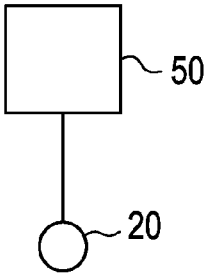
Figure 7F:
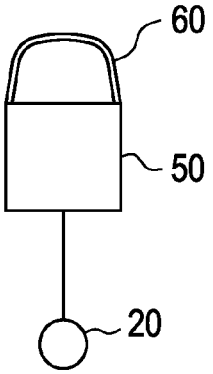
Figure 7G:
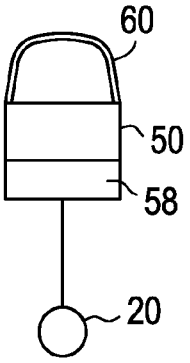
Figure 7H:
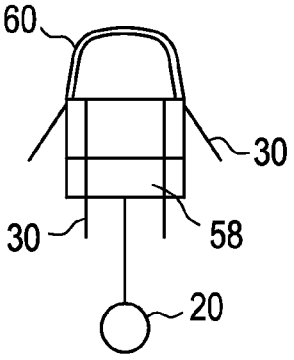
Figure 7I:
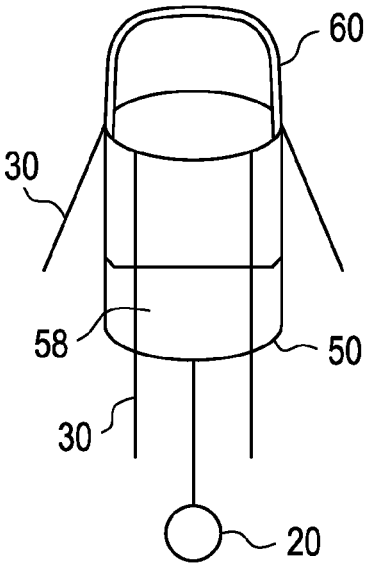
Figure 7J:
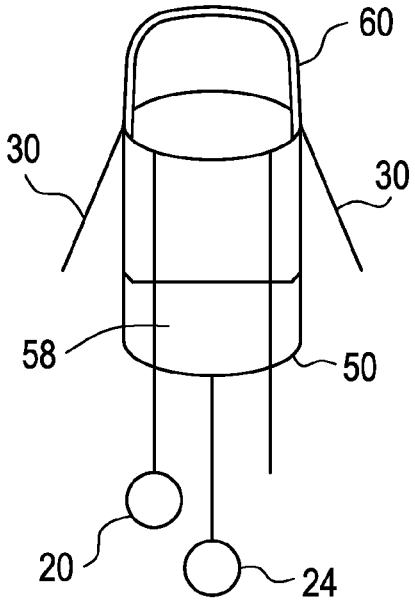
Figure 7K:
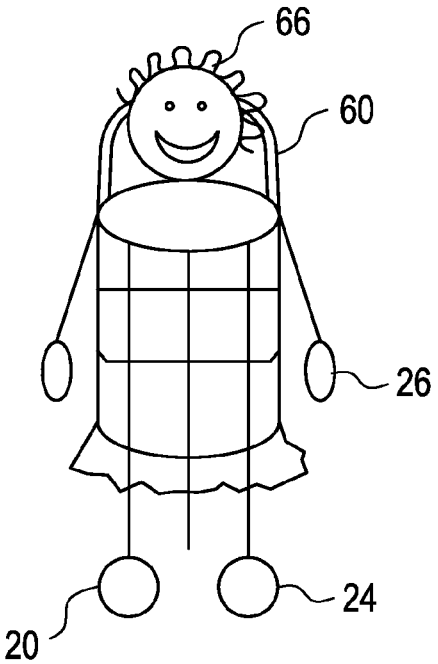
Figure 7L:
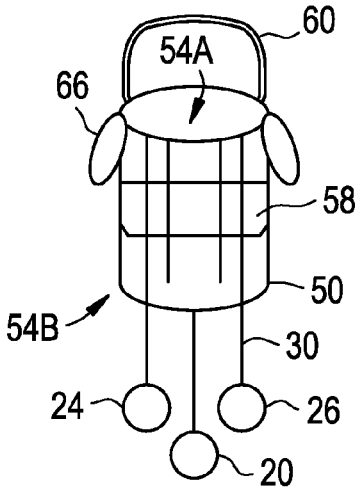
Figure 7M:
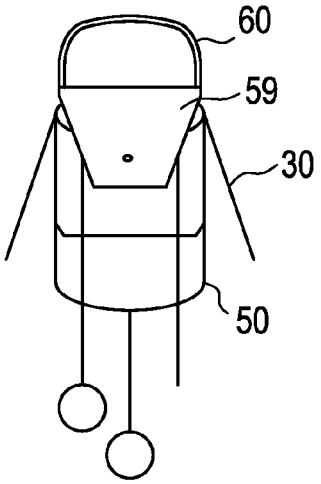
Figure 7N:
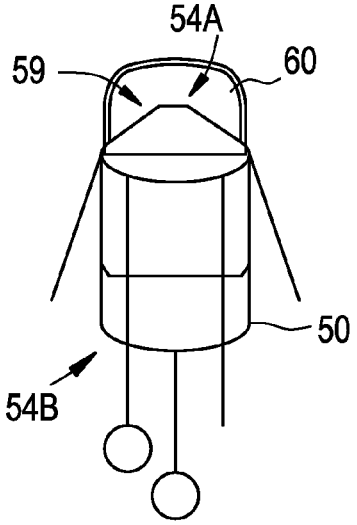
Figure 7O:
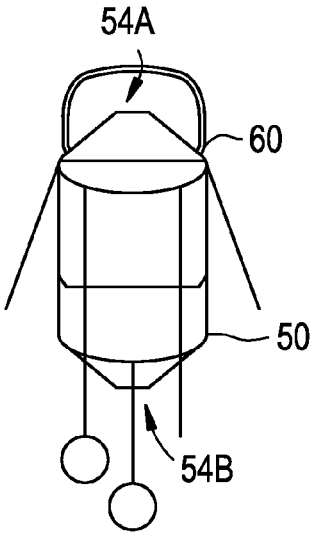
Figure 7P:
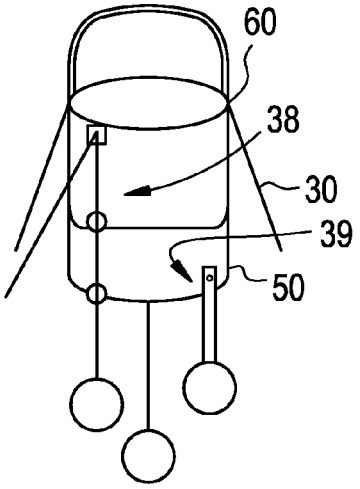

In one embodiment, illustrated in FIGS. 3A and 3B, a device 10", which is similar to device 10, may include a container 50. As shown in FIG. 3A, the first body 20, the second body 24 and one or more third bodies 26, which are similar in function and/or size and shape to the first body 20, are attached to the container 50 by one or more strands or tubes 30 (e.g., three strands or tubes 30 are shown). In one embodiment, the strand or tube 30 may be selectively attachable to the container 50 by, for example, a button, snap, magnet, clamp, clip, hook and loop, or like fastening mechanism. In one embodiment, a length of the strand or tube 30 maybe selectively extended or retracted relative to the container 50 by, for example, a buckle and loop arrangement 38 (FIG. 7P) or selectively attachable to the container 50 by a button or snap 39 (FIG. 7P).

In one embodiment, the container 50 is comprised of a cylindrical shape defining a chamber 52 open at a first end 54A and closed at a second end 54B of the container 50. The chamber 52 defines a volume suitable for storing items therein. In one embodiment, wherein the container 50 is comprised of fabric, leather, vinyl or like material, the second end 54B may be sewn or otherwise fastened or secured together to close the second end 54B. As can be appreciated, the container 50 and chamber 52 may be used to hold the flexible items 40, e.g., hair accessories, or other items of interest to the user such as, for example, handkerchief, combs, brushes, hair spray, hair gel, lotion or other products, and the like. It should be appreciated that a top, flap, lid, zipper or the like 59 (FIGS. 7M-7O) may be coupled to the container 50 and be selectively deployed to close the first end 54A and thus secure items stored in the chamber 52. In one embodiment, the top, flap or lid 59 may be secured in the closed position by a fastener such as, for example, a button, snap, magnet, hook and loop arrangement, or similar closure mechanism. In one embodiment, the chamber 52 may include a liner lining an internal surface thereof. In one embodiment, padding or stuffing (e.g., cotton, foam or the like) may be disposed under the liner, for example, at the second end 54B of the container 50, to stuff or pad the chamber 52 to enlarge the size or shape of the container 50.

As shown in FIGS. 3A and 3B, the container 50 may include a strap or band 56 disposed on an outer or inner surface of the container 50 for retaining additional flexible items 40 thereon. Similarly, the container 50 may include a selectively opening/closing pocket or flap 58 disposed on the outer or inner surface of the container for retaining the flexible items 40 or like items of interest to the user. In one embodiment, the pocket or flap 58 is comprised of transparent material such as, for example, mesh, plastic, tulle netting, or the like, such that flexible or other items placed in the pocket or flap 58 may be viewed within the pocket or flap. In one embodiment, a strap or hanger 60 is affixed about the first end 54A of the container 50 such that the device 10" may be affixed from or about, for example, a door, door knob, hook or like protrusion, shelf or like support surface (not shown). In one embodiment, illustrated in FIG. 3A, the device 10" may include a portable stand 80 such that the container 50 may be affixed thereto by hanging the strap or hanger 60 from a surface 82 thereof.

As shown in FIG. 3B, in one embodiment, the device 10" may include embellishments 66 that maybe selectively affixed to the device 10" to form a character image such as, for example, a fictional character like a prince or princess, dancer such as, for example, a ballerina, a wizard or witch, a monster, an alien, a cartoon image of an animal, a pirate, mad scientist, action figure, as well as actual or fictional characters such as an athlete, musician, actor or actress, music performer, or like characters of interest to children, adolescents and/or adults. In one embodiment, the embellishments 66 include facial features such as a depiction of a head or face, appendages such as legs, arms, feet, hands, a tail, articles of clothing such as, for example, a dress, shirt, jacket, skirt, or the like, that are affixed to a portion of the device 10" such as, for example, the container 50, the strap 60 or the like. In one embodiment, the device 10" may include indicia 64 displayed on a surface of the container 50 including, for example, text including sayings, slogans, brand names or the like, graphics including patterns or designs, or other decorative or aesthetic features as may be desired to users. It should be appreciated that it is within the scope of the present invention for the indicia 64 and the embellishments 66 to be considered broadly, for example, as including materials added to the device 10" to facilitate a preferred or desired ornamental or aesthetic appearance of interest to potential consumers.

Figure 4A:
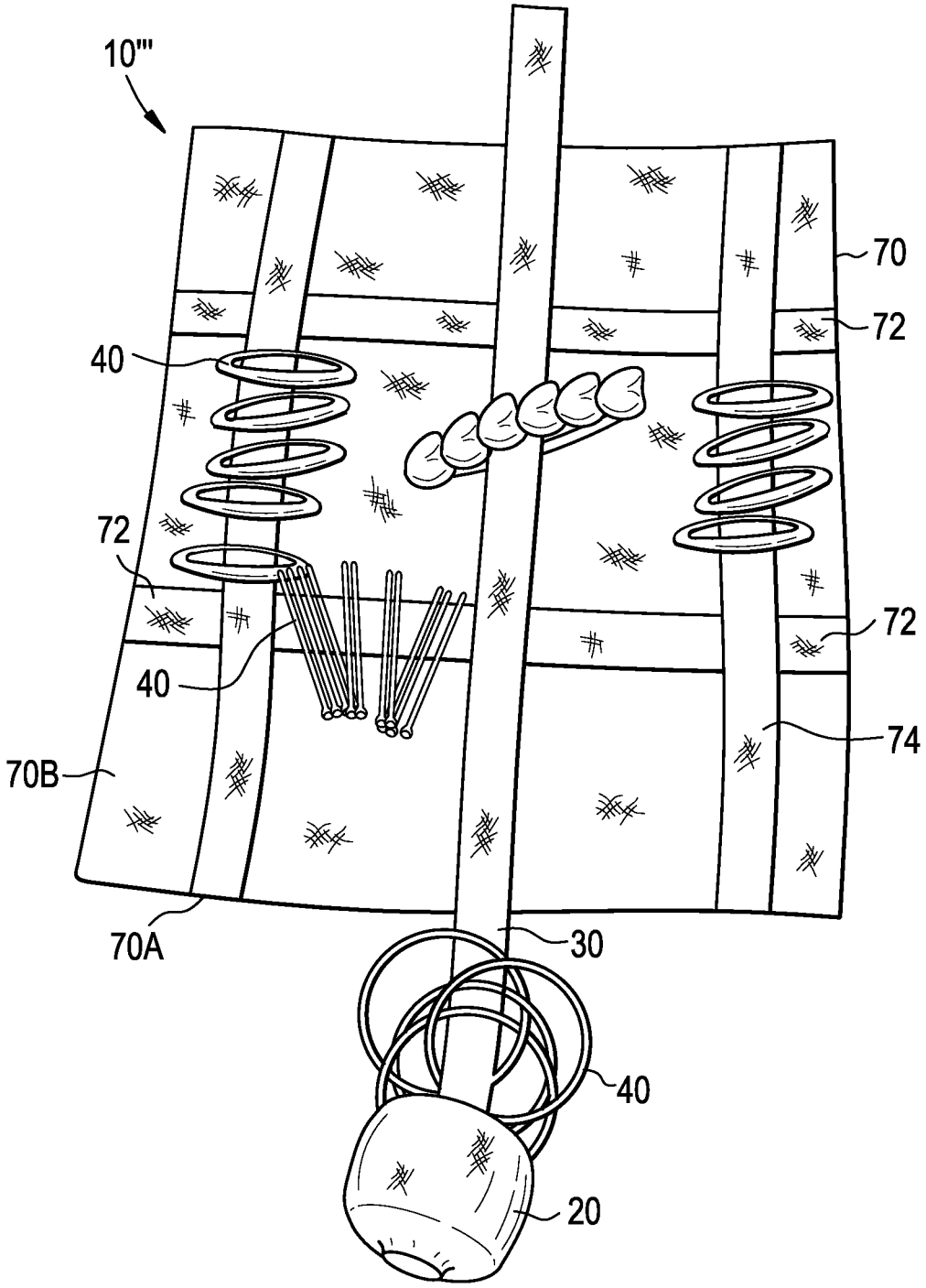
FIGS. 4A-4D are perspective views of a device for storing and organizing flexible items, configured in accordance with one embodiment of the present invention.
Figure 4B:
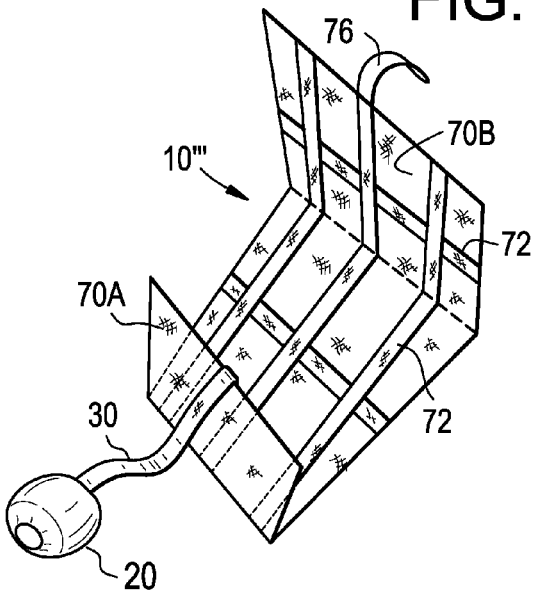
Figure 4C:
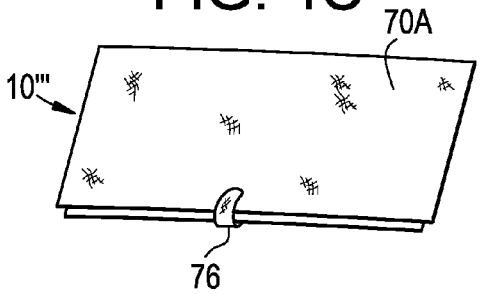
Figure 4D:
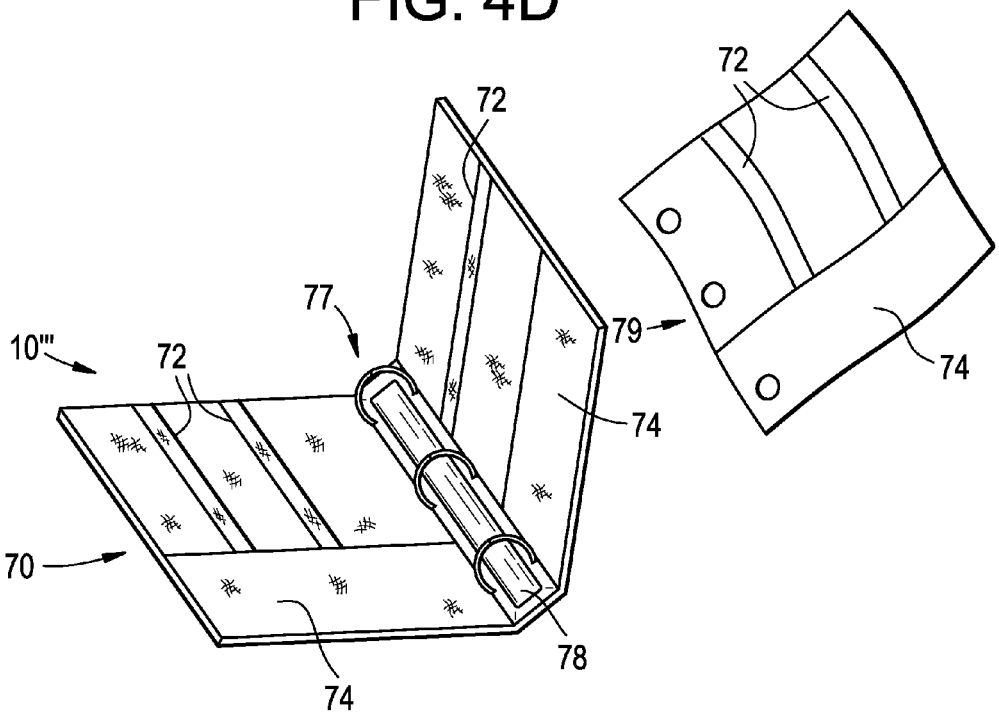

In one embodiment, illustrated in FIGS. 4A-4D, a device 10''', which is similar to device 10, includes a flat foldable wallet, valise or similar portable, carrying container 70. The carrying container 70 includes an external surface 70A and an internal surface 70B and is configurable in an open position (FIG. 4A), a closed position (FIG. 4C) and one or more intermediate positions (FIG. 4B) between the open and the closed position. As illustrated in FIGS. 4A and 4B, one or more strands or tubes 30 may affix one or more first, second or third bodies 20, 24 or 26, respectively, from the carrying container 70. Similar to the container 50, the carrying container 70 may also include one or more straps or bands 72 for retaining additional flexible items 40 thereon, as well as one or more pockets or selectively opening/closing pockets or flaps 74 for retaining flexible items 40 or like items of interest to the user. As should be appreciated, the carrying container 70 may be selectively folded and unfolded in sections (e.g., bifold, trifold or the like) upon or within itself to form a relatively flat, compressed package (FIG. 4C) suitable for transportation in a relatively small bag, briefcase, handbag, pocketbook, piece of luggage, suitcase or the like. In one embodiment, the carrying container 70 includes a strap 76 having, for example, a button, snap, magnet, clamp, clip, hook and loop, tie or like fastening mechanism to retain the container 70 in the closed position. It should be appreciated that when folded, the one or more first, second or third bodies 20, 24 or 26, respectively, may be disposed within the carrying container 70 to secure the flexible items 40 therein, or outside of the carrying container 70 for access to the flexible items 40. In one embodiment, illustrated in FIG. 4D, the carrying container 70 may include a relatively rigid spine or binding 77 including a fastening mechanism 78 such as, for example, a clamp or set of rings, for retaining flexible items 40 and/or other items within the carrying container 70. In one embodiment, the spine or binding 77 and fastening mechanism 78 may be comprised of a binder type clamping mechanism. In this embodiment, one or more insert 79 may be added to the carrying container 70 to supplement storage and organization of the flexible items 40 and/or other items within the carrying container 70. The inventor has recognized that the portable carrying container 70 may be particularly well suited by, for example, professionals in the field of hair styling that need ready access to a large quantity and/or assortment of hair accessories.

Figure 5A:
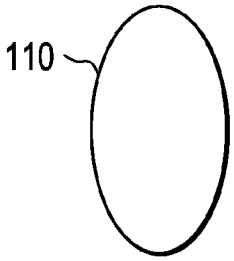
FIGS. 5A-5F and 6A-6C illustrate one embodiment of methods for constructing the devices for storing and organizing flexible items, in accordance with one embodiment of the present invention.
Figure 5B:
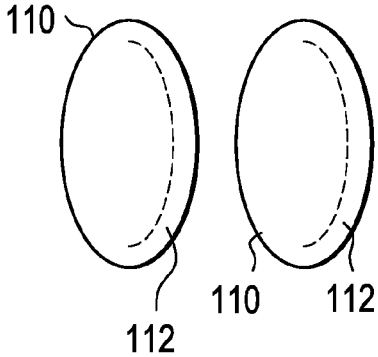
Figure 5C:
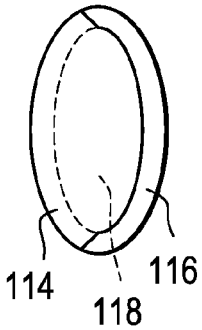
Figure 5D:
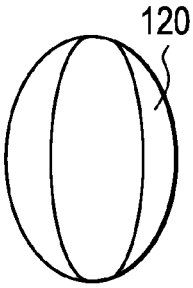
Figure 5E:
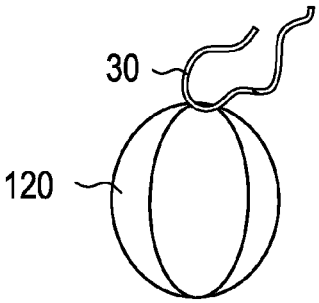
Figure 5F:
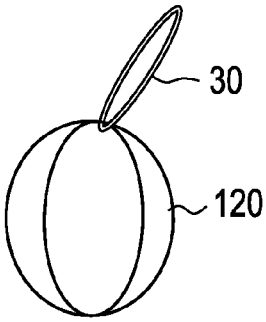
Figure 8A:
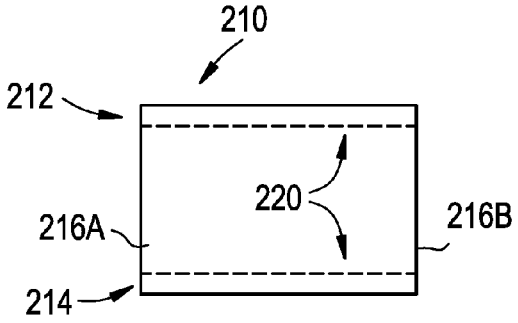
FIGS. 8A-8E illustrate one embodiment of methods for constructing the devices for storing and organizing flexible items, in accordance with one embodiment of the present invention.
Figure 8B:
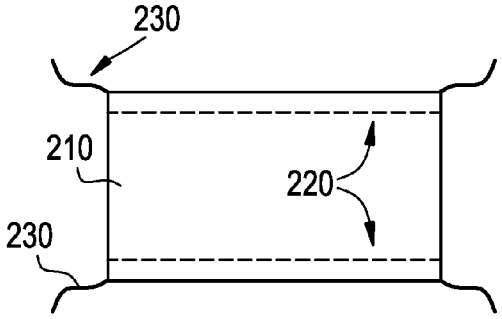
Figure 8C:
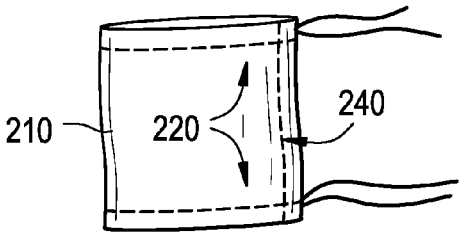
Figure 8D:
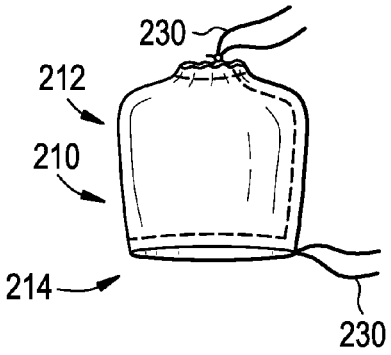
Figure 8E:
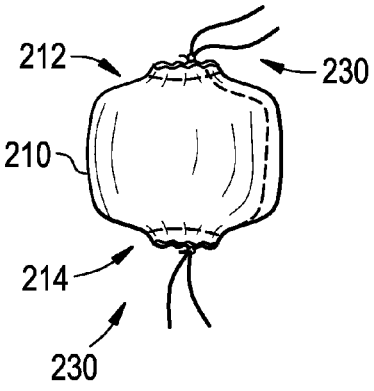

With reference to FIGS. 5A-5F, one exemplary method for constructing the device 10 for storing and organizing flexible items, including the first body 20 and strand 30 as depicted in FIG. 1, includes the following steps. As an initial step, four pieces of a fabric material are cut to an exemplary shape 110 (not to scale) as illustrated in FIG. 5A. Next, two of the shapes 110 are sewn together on one side 112, providing two shapes as shown in FIG. 5B. The two shapes 110 are then sewn together at one side 114, leaving an outside seam 116 open and an interior cavity 118, as shown in FIG. 5C. Next, the shapes are turned right side out and the interior cavity 118 is fill with stuffing or padding 23 such as, for example, cotton, foam or the like (not shown for clarity of illustration). Once stuffed, the outside seam 116 is sewn closed to complete a ball or sphere-like structure 120. With the ball or sphere-like structure 120 complete, the strand 30 is attached to an outer surface of the structure 120 at an end of the strand 30 or, alternatively, at a point along the length of the strand 30 as is shown in FIG. 5E. When the alternative construction is employed such that the strand 30 is attached to the ball or sphere-like structure 120 at the point along its length, ends of the strand 30 are then attached to form a loop as is shown in FIG. 5F. As described above with reference to FIG. 1, the ball or sphere-like structure 120 and strand 30 may be used to store and organize the flexible items 40. In another embodiment, illustrated in FIGS. 8, the ball or sphere-like structure 120 may be formed by a sewing technique referred to herein as "cinching." As shown in FIG. 8A, ends 212 and 214 of material 210 comprising, for example, fabric, leather, vinyl or like material, is wrapped or folded and then sewn to form seams 220. A strand, string, ribbon or the like 230 is disposed in each of the seams 220. The material 210 is then folded, for example, in half, and another seam 240 is sewn to close the ends 216A and 216B (FIGS. 8A and 8C). As shown in FIG. 8D, the strand 230 at one end (e.g., the end 212) is pulled tight or "cinched" to close the end. Optionally, the material 210 is turned inside out and stuffed or padded. As shown in FIG. 8E, the strand 230 at the opposite end (e.g., the end 214) of the material 210 is then pulled tight or cinched to close the end, thereby forming the ball or sphere-like structure 120.

Figure 6A:
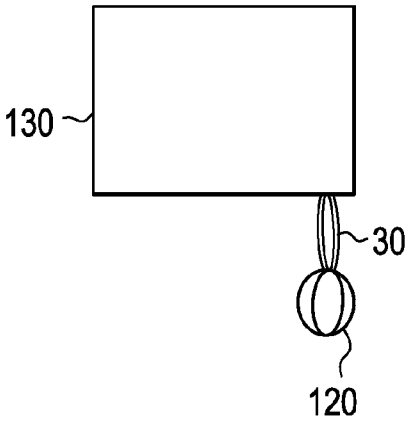
Figure 6B:
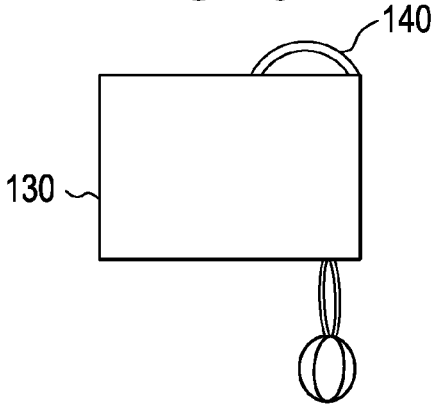
Figure 6C:
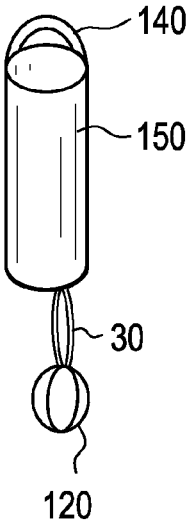

With reference to FIGS. 6A-6C, one exemplary method for constructing the device 10" for storing and organizing flexible items, including the ball or sphere-like structure 120, strand 30 and a container 150, similar to container 50, as depicted in FIG. 3, includes the following steps. As shown in FIG. 6A, the strand 30 of the ball or sphere-like structure 120 is coupled to a piece of fabric material 130. A loop or strap 140 is affixed to the fabric material 130 as a handle. The fabric material 130 is then arranged in a cylindrical shape, turned inside out and an end in proximity to the ball 120 is sewn closed to form a pouch 150 such that the cylindrical shape and closed end form an internal chamber for retaining items therein. In one embodiment, a portion of the closed end may be stuffed or padded to provide thickness, depth and/or additional structure to the pouch 150.

One or more embodiments of the present invention have been described. Nevertheless, it will be understood that various modifications may be made without departing from the spirit and scope of the invention. For example, many construction techniques and materials may be utilized as is illustrated in FIGS. 7A-7P. FIG. 7A illustrates a single body (e.g., the first body 20) and the strand 30. FIG. 7B illustrates the single body and the strand 30 configured as a loop. FIG. 7C illustrates the first body 20 and the second body 24 configuration. Similarly, FIG. 7D illustrates the first body 20, the second body 24 and the strand 30 as the loop configuration. FIG. 7E illustrates the first body 20 attached to material (e.g., the container 50). FIG. 7F illustrates the first body 20 attached to the material 50 with hanging loop 62. FIG. 7G illustrates the first body 20 attached to the material 50 with the hanging loop 60 and the pocket 58. FIG. 7H illustrates the first body 20 attached to the material 50 with the hanging loop 60, the pocket 58, and additional strands 30. FIG. 71 illustrates the first body 20 attached to the container 50 with the hanging loop 60, the pocket 58 and the additional strands 30. FIG. 7J illustrates the first body 20 and the second body 24 attached to container 50 with the hanging loop 60, the pocket 58 and the additional strands 30. FIG. 7K illustrates a plurality of bodies (e.g., the first body 20, the second body 24, the third body 26) attached to the container 50 with the hanging loop 60, the pocket 58, the additional strands 30 and the embellishments 66. FIG. 7L illustrates the plurality of bodies attached to the container 50 with the hanging loop 60, the pocket 58, the additional strands and/or loops 30 and the embellishments 66. FIG. 7M illustrates the flap 59 with a closure to close the container 50 and the internal volume thereof. As described above, the closure can be flap top, zipper, button, snaps, magnetic, cinched, hook and loop or other fastening mechanism. For example, as shown in FIG. 7N the flap 59 is shown as a cinched closure. As shown in FIG. 7O, both ends of the container 50 may be closed with the cinched closure. FIG. 7P illustrates a selectively retractable strand 30 with the buckle and loop arrangement 38 and the selectively attachable and detachable strand 30 with button, snap, hook and loop or magnets fastener 39.

Accordingly, other embodiments are within the scope of the following claims.

What is claimed is:

1. A device for storing and organizing flexible objects including hair accessories, the device comprising:

a first body having a surface arranged to define an internal cavity, the internal cavity containing padding to enlarge the first body to a desired size and shape;

a strand or tube attached to the surface and extending outwardly from the first body; and a container having a cylindrical shape defining a chamber, the container having an opened end and a closed end such that the chamber defines an internal volume between the opened end and the closed end, the internal volume suitable for storing flexible items and other items therein;

the container is coupled to the strand or tube at an end of the strand or tube opposite from the first body;

wherein a flexible object is positioned over the strand or tube and retained by the strand or tube and the first body.

2. The device of claim 1, wherein the first body is comprised of at least one of fabric, paper, plastic and foam material.

3. The device of claim 1, wherein the strand or tube is comprised of fabric, metal, wire, string, yarn, plastic, or ribbon having a desired thickness or diameter and a length.

4. The device of claim 1, further including a second body having a second surface arranged to define a second internal cavity, the second cavity containing padding to enlarge the second body to a desired size and shape, the second body coupled to the strand or tube at an end of the strand or tube opposite from the first body.

5. The device of claim 1, further including embellishments selectively affixed to the device such that the device forms a character image.

6. The device of claim 5, wherein the character image includes an image of an actual or a fictional character.

7. A device for storing and organizing flexible objects including hair accessories, the device comprising:

a first body having a surface arranged to define an internal cavity, the internal cavity containing padding to enlarge the first body to a desired size and shape;

a strand or tube attached to the surface and extending outwardly from the first body;

a foldable carrying container having an external surface and an internal surface, the foldable container being selectively configurable in an open position, a closed position and positions between the open and closed positions; and one or more straps coupled to the internal surface to retain the flexible items thereon;

the carrying container is coupled to the strand or tube at an end of the strand or tube opposite from the first body;

wherein a flexible object is positioned over the strand or tube and retained by the strand or tube and the first body.

8. The device of claim 7, wherein the first body is comprised of at least one of fabric, paper, plastic, foam and wood material.

9. The device of claim 7, wherein the strand or tube is comprised of fabric, metal, wire, string, yarn, plastic, or ribbon having a desired thickness or diameter and a length.

10. A device for storing and organizing flexible objects including hair accessories, the device comprising:

a first body having a surface configured to define a desired size and shape;

a strand or tube attached to the surface and extending outwardly from the first body; and a container having a cylindrical shape defining a chamber, the container having an opened end and a closed end such that the chamber defines an internal volume between the opened end and the closed end, the internal volume suitable for storing flexible items and other items therein;

the container is coupled to the strand or tube at an end of the strand or tube opposite from the first body;

wherein a flexible object is positioned over the strand or tube and retained by the strand or tube and the first body.

11. The device of claim 10, further including embellishments selectively affixed to the device such that the device forms a character image.

12. The device of claim 11, wherein the character image includes an image of an actual or a fictional character.

13. A device for storing and organizing flexible objects including hair accessories, the device comprising:

a first body having a surface configured to define a desired size and shape;

a strand or tube attached to the surface and extending outwardly from the first body;

a foldable carrying container having an external surface and an internal surface, the foldable container being selectively configurable in an open position, a closed position and positions between the open and closed positions; and one or more straps coupled to the internal surface to retain the flexible items thereon;

the carrying container is coupled to the strand or tube at an end of the strand or tube opposite from the first body;

wherein a flexible object is positioned over the strand or tube and retained by the strand or tube and the first body.

* * * * *